US011219273B2

(12) United States Patent
Notrica et al.

(10) Patent No.: US 11,219,273 B2
(45) Date of Patent: Jan. 11, 2022

(54) FOOTWEAR UPPER COMPRISING STRETCH ZONES

(71) Applicant: LULULEMON ATHLETICA CANADA INC., Vancouver (CA)

(72) Inventors: Michael Andrew Notrica, Portland, OR (US); Mark Arthur Oleson, Portland, OR (US); Donald Taylor Johnston, Portland, OR (US); Christopher Ka-Yin Lam, Portland, OR (US)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 0 days.

(21) Appl. No.: 17/178,126

(22) Filed: Feb. 17, 2021

(65) Prior Publication Data

US 2021/0195998 A1 Jul. 1, 2021

Related U.S. Application Data

(63) Continuation of application No. PCT/CA2020/051213, filed on Sep. 9, 2020.
(Continued)

(51) Int. Cl.
*A43B 23/02* (2006.01)

(52) U.S. Cl.
CPC ..... *A43B 23/028* (2013.01); *A43B 23/0205* (2013.01); *A43B 23/0235* (2013.01); *A43B 23/0265* (2013.01)

(58) Field of Classification Search
CPC ..... A43B 23/0235; A43B 23/024; A43B 23/0265; A43B 23/028; A43B 23/0205
(Continued)

(56) References Cited

U.S. PATENT DOCUMENTS 5,345,638 A * 9/1994 Nishida ..... A41H 3/08 12/146 C
10,376,018 B2 8/2019 Rushbrook et al.
(Continued)

FOREIGN PATENT DOCUMENTS

WO 2007030383 A3 3/2007
WO 2014011912 A1 1/2014

OTHER PUBLICATIONS

Canadian Intellectual Property Office, International Search Report and Written Opinion of the International Searching Authority, dated Nov. 26, 2020, in PCT/CA2020/051185, which is the international application to which this U.S. application claims priority.

*Primary Examiner* — Marie D Bays
(74) *Attorney, Agent, or Firm* — Kolitch Romano LLP

(57) ABSTRACT

An upper of an article of footwear comprises a plurality of stretch zones each having a respective stretching capability. Suitable example stretch zones may include four-way stretch zones, two-way stretch zones, and/or lock-out zones. In some examples, an upper having a plurality of stretch zones comprises a single continuous piece of material configured to have regions of different stretching capability. The single piece of material may comprise a layered material having two stretchable outer layers, wherein a plurality of stretch zones of the piece of material are defined by corresponding intermediate layers disposed at selected locations between the outer layers. Examples of intermediate layers providing two-way stretch, four-way stretch, and little or no stretch are disclosed.

14 Claims, 12 Drawing Sheets

Related U.S. Application Data

(60) Provisional application No. 62/953,718, filed on Dec. 26, 2019.

(58) Field of Classification Search
USPC ..... 36/45
See application file for complete search history.

(56) References Cited

U.S. PATENT DOCUMENTS

2005/0193592 A1* 9/2005 Dua ..... D04B 1/102 36/45
2006/0283042 A1 12/2006 Greene et al.
2008/0083138 A1* 4/2008 Lacorazza ..... A43B 23/0255 36/97
2010/0077634 A1* 4/2010 Bell ..... A43B 23/04 36/54
2012/0255201 A1 10/2012 Little
2012/0297642 A1* 11/2012 Schaefer ..... A43B 1/0027 36/45
2013/0174446 A1* 7/2013 Antonelli ..... A43B 13/223 36/45
2013/0232815 A1* 9/2013 Meythaler ..... A43B 5/025 36/45
2014/0173932 A1* 6/2014 Bell ..... A43B 23/0265 36/84
2014/0310984 A1* 10/2014 Tamm ..... D04B 1/102 36/84
2015/0075031 A1* 3/2015 Podhajny ..... D04B 1/123 36/45
2017/0049186 A1* 2/2017 Lee ..... A43B 5/003
2017/0099909 A1* 4/2017 Lee ..... A43C 11/006
2017/0238658 A1* 8/2017 Gu ..... A43B 23/08
2018/0116339 A1* 5/2018 Luh ..... A43B 23/0265
2018/0352905 A1* 12/2018 Chang ..... A43B 23/0235
2019/0029368 A1* 1/2019 Crumbleholme ..... B32B 37/06
2019/0037968 A1* 2/2019 DeWillie ..... A43B 21/20
2019/0039311 A1* 2/2019 Busbee ..... A43D 999/00
2019/0069639 A1* 3/2019 Arzt ..... A43B 23/025
2019/0166950 A1* 6/2019 Sinclair ..... A43B 23/0245
2019/0231021 A1* 8/2019 Hoying ..... A43B 23/0265
2019/0289962 A1* 9/2019 Costa ..... A43B 23/04
2019/0380438 A1* 12/2019 Luh ..... D04B 1/22
2021/0030116 A1* 2/2021 Bruner ..... A43B 23/0265
2021/0037913 A1* 2/2021 Bessho ..... A43B 9/02

* cited by examiner

FOOTWEAR UPPER COMPRISING STRETCH ZONES

CROSS-REFERENCES

The following applications and materials are incorporated herein, in their entireties, for all purposes: U.S. Provisional Patent Application Ser. No. 62/953,718, filed Dec. 26, 2019.

FIELD

This disclosure relates to systems and methods for footwear. More specifically, the disclosed embodiments relate to footwear uppers having selected stretchability characteristics.

INTRODUCTION

An article of footwear typically comprises a sole configured to support a wearer's foot and an upper configured to retain the foot against the sole. The upper is typically designed to at least partially stabilize the foot relative to the sole in a secure and comfortable fit. By stabilizing the foot, the upper tends to prevent the foot from moving relative to the sole in a manner that could lead to injury, discomfort, and/or reduced athletic performance.

SUMMARY

The present disclosure provides systems, apparatuses, and methods relating to footwear uppers comprising stretch zones.

In some embodiments, an article of footwear includes: a continuous sheet of layered material including a plurality of stretch zones, each stretch zone defined by a selected directional elasticity; and exactly one seam at which the continuous sheet is coupled to itself to form an upper; wherein the plurality of stretch zones comprise at least two zones having different respective directional elasticities.

In some embodiments, an article of footwear includes: an upper including a single continuous sheet comprising two or more stretch zones, each stretch zone having a different directional stretching capability; and a sole coupled to the upper.

In some embodiments, a method of manufacturing an upper for an article of footwear includes: sandwiching a patterned intermediate layer between two elastic outer layers; connecting the intermediate layer to the outer layers to form a single continuous sheet including a plurality of zones having different stretch characteristics due to the patterned intermediate layer; forming an upper out of the single continuous sheet; and lasting the upper.

Features, functions, and advantages may be achieved independently in various embodiments of the present disclosure, or may be combined in yet other embodiments, further details of which can be seen with reference to the following description and drawings.

DETAILED DESCRIPTION

Figure 1:
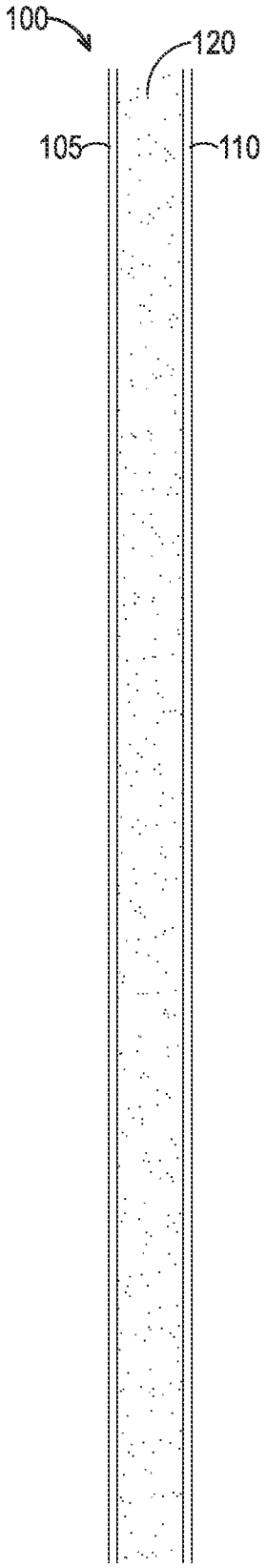
FIG. 1 is a sectional view of an illustrative layered material suitable for forming an upper having a plurality of stretch zones, in accordance with aspects of the present disclosure.

Various aspects and examples of footwear uppers comprising a plurality of stretch zones, as well as related methods, are described below and illustrated in the associated drawings. Unless otherwise specified, an upper in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections, each of which is labeled accordingly.

Definitions

The following definitions apply herein, unless otherwise indicated.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

The terms "medial," "lateral," "anterior," "posterior," and the like are intended to refer to anatomical directions corresponding to a human foot. For example, "medial" refers to a relative position disposed toward the center of the human body, while "lateral" refers to a relative position disposed away from the center of the human body. "Anterior" refers to a relative position closer to the toe of a wearer and "posterior" refers to a relative position closer to the heel of the wearer. In the absence of a wearer, the same directional terms may be used as if the article of footwear is being worn in its expected configuration.

"Coupled" means connected, either permanently or releasably, whether directly or indirectly through intervening components.

"Resilient" describes a material or structure configured to respond to normal operating loads (e.g., when compressed) by deforming elastically and returning to an original shape or position when unloaded.

"Rigid" describes a material or structure configured to be stiff, non-deformable, or substantially lacking in flexibility under normal operating conditions.

"Elastic" describes a material or structure configured to spontaneously resume its former shape after being stretched or expanded.

Directional terms such as "up," "down," "vertical," "horizontal," and the like should be understood in the context of the particular object in question. For example, an object may be oriented around defined X, Y, and Z axes. In those examples, the X-Y plane will define horizontal, with up being defined as the positive Z direction and down being defined as the negative Z direction.

"Providing," in the context of a method, may include receiving, obtaining, purchasing, manufacturing, generating, processing, preprocessing, and/or the like, such that the object or material provided is in a state and configuration for other steps to be carried out.

In this disclosure, one or more publications, patents, and/or patent applications may be incorporated by reference. However, such material is only incorporated to the extent that no conflict exists between the incorporated material and the statements and drawings set forth herein. In the event of any such conflict, including any conflict in terminology, the present disclosure is controlling.

Overview

In general, a footwear upper in accordance with aspects of the present teachings comprises a plurality of stretch zones integrated within a single sheet of material, each stretch zone being characterized by a directional stretching capability (e.g., an elasticity and/or resiliency along the surface of the material of the zone). Suitable types of stretching capability may include, e.g., two-way stretch, four-way stretch, little to no stretch, and/or any other suitable type or degree of stretch. The location of each stretch zone in the upper can be selected to achieve a desired fit and function. For example, a zone configured to stretch by a relatively large amount may be located in a portion of the upper that is expected to stretch with certain movements of the wearer, and a zone having little to no stretching capability may be located in a portion of the upper where stretching is undesirable.

In some examples, the plurality of zones includes at least one two-way stretch zone. A two-way stretch zone is configured to stretch along a predetermined stretch axis (e.g., the X axis) and to stretch to little or no extent along an axis orthogonal to the stretch axis (e.g., the Y axis). In examples including two or more two-way stretch zones, separate two-way stretch zones do not necessarily have the same degree of elasticity.

Alternatively, or additionally, the plurality of zones may include at least one four-way stretch zone configured to stretch along a first axis and along a second axis orthogonal to the first axis (e.g., in any direction in the X-Y plane). In some examples, a four-way stretch zone has generally elastic characteristics in any given direction. A four-way stretch zone may have the same degree of elasticity along the first axis as along the second axis, or different degrees of elasticity along the two axes. In examples including two or more four-way stretch zones, separate four-way stretch zones do not necessarily have same degrees of elasticity.

Alternatively, or additionally, the upper may include at least one non-stretch zone configured to remain substantially undeformed. In other words, a non-stretch zone has little to no elasticity along any axis under normal conditions (e.g., an inelastic zone).

The upper may be formed from a single piece of material including multiple stretch zones, or from multiple pieces of material, at least one of which includes two or more stretch zones. In some examples, all zones included within an upper are formed within the same piece of material. In some examples, a single piece of material including two or more stretch zones is connected (e.g., by stitching, adhering, etc.) to other pieces of material, which may each include one or more stretch zones.

A piece of material or sheet integrally forming two or more zones may be manufactured and/or treated in any suitable way to comprise the two or more zones. In some examples, including those described further below, the sheet is a layered material having a first surface layer, a second surface layer, and one or more intermediate layers disposed between the first and second surface layers, in at least some parts of the sheet. In some examples, the first surface layer and the second surface layer comprise fabric having a four-way stretch. The intermediate layer(s) are configured to confine or limit the stretch characteristics of the first and second layers, providing a selected stretching capability in the corresponding portion of the material. The intermediate layers may include any suitable material and/or structure configured to provide the desired stretch pattern, such as foams, adhesives, adhesive sheets, and/or the like, which may be shaped or patterned to provide desired behavior (see below). Alternatively, or additionally, the material may comprise one or more woven layers having different patterns and/or densities of weave at different locations, corresponding to different stretch or non-stretch zones.

An upper in accordance with aspects of the present teachings may comprise any suitable arrangement of stretch zones (including non-stretch zones), and may be coupled to a sole and/or other footwear components in any suitable manner to form an article of footwear. Examples disclosed herein relate to athletic footwear, but in general, an upper in accordance with aspects of the present teachings may be part of any suitable type of shoe. The arrangement of stretch zones of the upper may be selected to render the shoe particularly suitable for a desired type of activity. For example, an upper may have a custom or selected arrangement of stretch zones configured for stabilizing a foot during walking, running, court sports, and/or any other suitable activity. Additionally, or alternatively, an arrangement of stretch zones may be configured for stabilizing a foot against certain types of injury (e.g., ankle injuries).

A method of manufacturing an upper according to the present disclosure may include: generating an intermediate support layer, positioning the intermediate support layer between two external layers, bonding the intermediate support layer to the two external layers, forming the resulting sheet into an upper for an article of footwear, optionally lasting the upper, and optionally coupling the upper to a sole.

Examples, Components, and Alternatives

The following sections describe selected aspects of illustrative uppers having a plurality of distinct stretch zones, as well as related systems and/or methods. The examples in these sections are intended for illustration and should not be interpreted as limiting the scope of the present disclosure. Each section may include one or more distinct embodiments or examples, and/or contextual or related information, function, and/or structure.

The following reference numerals may be utilized in the accompanying drawings:

100 sheet
105 first outer layer
110 second outer layer
120 intermediate lock-out layer
140 intermediate two-way stretch layer
144 ladder-shaped grid
148 rail of ladder-shaped grid
152 rung of ladder-shaped grid
154 longitudinal axis of ladder-shaped grid
156 opening of ladder-shaped grid
160 transverse axis
170 intermediate four-way stretch layer
174 sheet
178 openings in sheet
184 first stretching axis of intermediate four-way layer
186 second stretching axis of intermediate four-way layer
190 intermediate stretch layer
192 sheet
194 openings in sheet
196 first stretching axis of intermediate layer
19 second stretching axis of intermediate layer 200 sheet of material
202, 204 outer layers
210 lock-out zones
220 two-way stretch zones
230 four-way stretch zones
250 intermediate layer
300 upper
305 last
310 lock-out zone
314 main portion of lock-out zone
316 heel portion of upper
318 lateral portion of upper
322 top portion of lock-out zone
326 medial portion of upper
330 toe portion of lock-out zone
338 toebox portion of upper
340 medial four-way stretch zone
344 vertical axis
346 horizontal axis
350 top four-way stretch zone
354 first axis
358 second axis
370 two-way stretch zone
374 axis of two-way stretch zone
400 single-piece upper
405 shoe including single-piece upper
407 sole of shoe
410 lock-out zone
414 main portion of lock-out zone
422 top portion of lock-out zone
430 toe portion of lock-out zone
440 medial four-way stretch zone
450 top four-way stretch zone
470 two-way stretch zone
480 seam
486 heel portion of single-piece upper

A. Illustrative Layered Material

Figure 2:
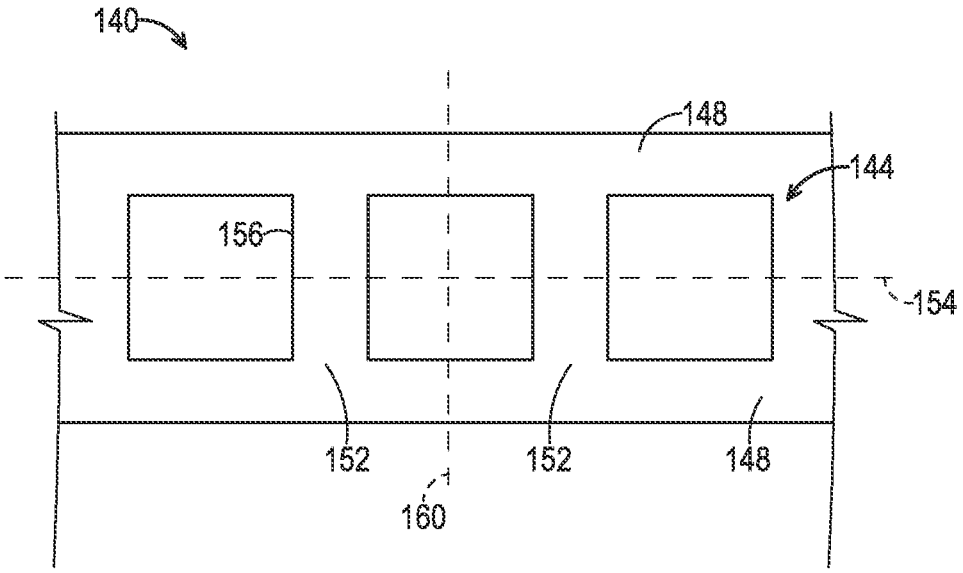
FIG. 2 is a top view of an illustrative intermediate layer suitable for inclusion in the layered material of FIG. 1 for forming a two-way stretch zone.
Figure 3:
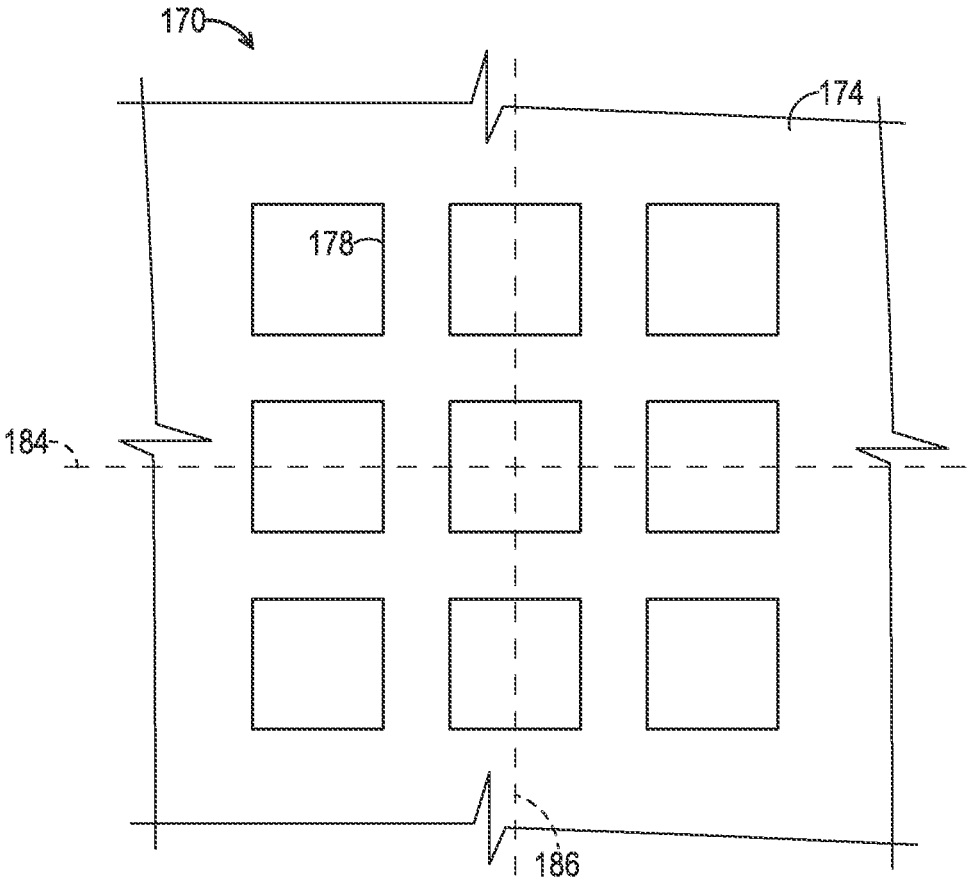
FIG. 3 is a top view of an illustrative intermediate layer suitable for inclusion in the layered material of FIG. 1 for forming a four-way stretch zone.

FIGS. 1-3 depict an illustrative sheet 100 including multiple stretch zones within a single piece of material. Sheet 100 may be suitable for use in uppers described herein, such as upper 300, upper 400, or any suitable upper having any suitable arrangement of stretch and/or non-stretch zones.

FIG. 1 is a sectional side view of sheet 100. As FIG. 1 shows, sheet 100 has a first outer layer 105 and a second outer layer 110. In some examples, first and second outer layers 105 and 110 are identical or nearly identical to each other. In other examples, they differ from each other in composition, thickness, and/or any other suitable aspect(s).

In general, first and second outer layers 105 and 110 are each configured to have four-way stretch. The overall stretching ability of a given region of material 100 therefore depends on the stretching ability of any material disposed between first and second outer layers 105 and 110. Accordingly, one or more four-way stretch zones, two-way stretch zones, lock-out zones, and/or any other suitable zones are defined by the material (or absence of material) disposed between layers 105 and 110 in the appropriate regions of the upper. A single piece of sheet 100 may comprise a plurality of distinct stretch zones based on the intermediate material disposed between layers 105 and 110. Any suitable intermediate layers may be used to form desired stretch zones, including any desired non-stretch zones. Specific examples of suitable intermediate layers are described below.

For example, the portion of sheet 100 depicted in FIG. 1 has an intermediate lock-out layer 120 disposed between outer layers 105 and 110, which is generally inelastic and configured to remain substantially unstretched in all directions. In the example depicted in FIG. 1, lock-out layer 120 comprises a foam, but in other examples, any suitable material(s) may be used such as adhesive, tapes, fabrics, plastics, and/or the like. In general, a lockout layer may include any inelastic member coupled to the outer layers in a way that makes the overall portion of the sheet inelastic or substantially inelastic. For example, an unperforated, low-elasticity tape may serve as the intermediate layer. In some examples, lock-out layer 120 comprises a foam and an inelastic adhesive layer attaching external surfaces of the foam to the outer layers. The portion of material 100 depicted in FIG. 1 is suitable for forming a non-stretch zone of an upper, such as lock-out zone 310 of upper 300, and lock-out zone 410 of upper 400, depicted below.

FIG. 2 is a top view of an intermediate two-way stretch layer 140. Two-way stretch layer 140 may be disposed between outer layers 105 and 110 to form a region of material 100 having two-way stretch capability (i.e., single-axis elasticity). Layer 140 comprises at least one ladder-shaped grid 144 or lattice, which includes a pair of opposing rails 148 and a plurality of rungs 152. Rungs 152 are spaced from each other and each extend between rails 148. Rails 148 define a longitudinal axis 154. Rails 148 and rungs 152 comprise a material capable of stretching during ordinary operation. A plurality of ladder openings 156 are defined between rails 148 and pairs of rungs 152. In the depicted example, openings 156 are square-shaped, but in general the openings may have any suitable shape such as rectangular, hexagonal, octagonal, triangular, round, oblong, and/or the like. Openings 156 may have any suitable size for altering stretching characteristics of a sheet of material. Moreover, openings 156 may have any suitable combination of sizes and/or shapes, including different sizes and/or shapes within a same zone. In some examples, openings 156 have (e.g., a pattern of) varying sizes and/or shapes within a zone, engineered to achieve one or more desired overall characteristics. For example, openings 156 may change in size and/or shape such that elasticity is configured to change along the axis. For example, one or more dimensions of the openings may become smaller or larger along a longitudinal axis, forming a gradation with a corresponding stretch gradient. The openings may be larger in areas of the two-way stretch layer configured to have greater amounts of stretch and smaller in areas of the two-way stretch layer configured to have lesser amounts of stretch. The absence of material at openings 156 allows ladder-shaped grid 144 to stretch along longitudinal axis 154 to a much greater extent than along a transverse axis 160 orthogonal to the longitudinal axis. Accordingly, a portion of sheet 100 including intermediate two-way stretch layer 140 is suitable for forming a two-way stretch zone, such as two-way stretch zone 370 of upper 300. Specifically, grid 144 is oriented between layers 105, 110 such that longitudinal axis 154 is aligned with one of the stretching axes of layer 105 and also with the parallel stretching axis of layer 110. This allows a region of material 100 having intermediate two-way stretch layer 140 to have a two-way stretch capability. Any suitable number of ladder-shaped grids 144 may be disposed parallel to each other between outer layers 105 and 110 to form a portion of two-way stretch material.

Figure 13:
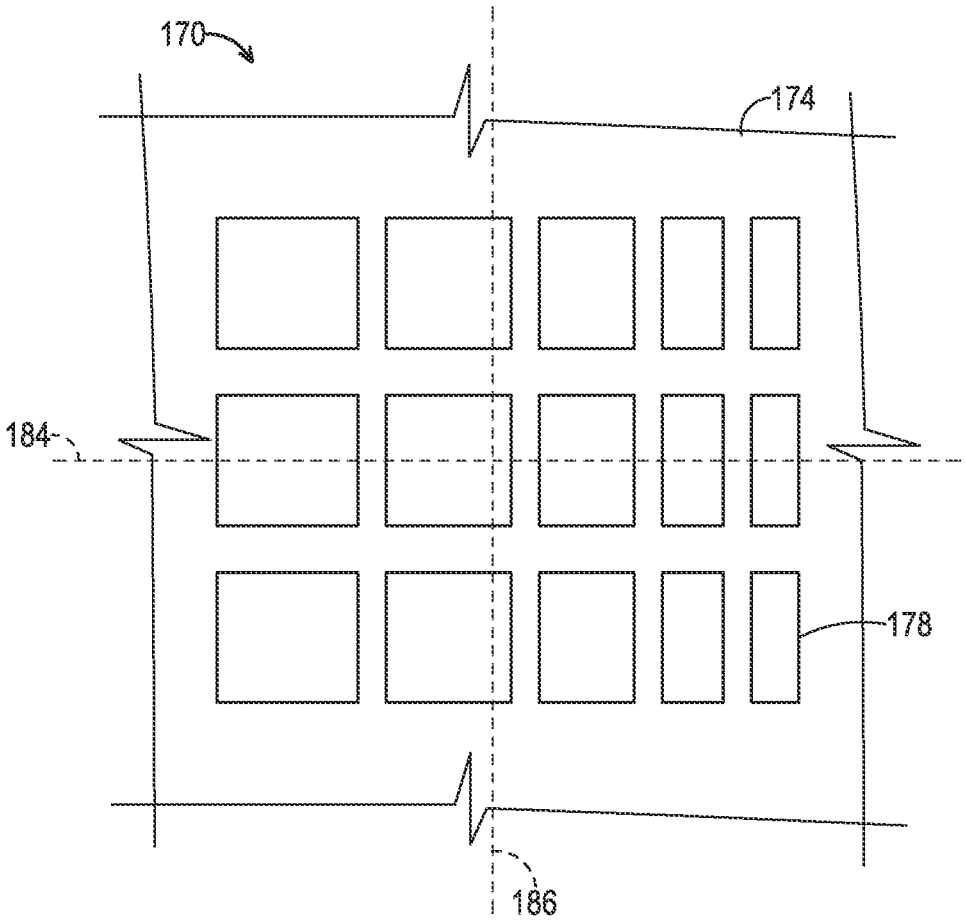
FIG. 13 is a top view of an illustrative intermediate layer suitable for inclusion in the layered material of FIG. 1 for forming a four-way stretch zone having variable stretch characteristics along one dimension.

FIG. 3 is a top view of an intermediate four-way stretch layer 170, which may be disposed between outer layers 105 and 110 to form a region of material 100 having four-way stretch capability (i.e., two-axis elasticity). Layer 170 comprises at least one stretchable sheet 174 having an array of openings 178. In the example depicted in FIG. 3, openings 178 are square-shaped, but in general the openings may have any suitable size or shape, such as rectangular, hexagonal, triangular, round, oblong, and/or the like. Openings 178 may have any suitable sizes or shapes for altering stretching characteristics of a sheet of material. The array of openings 178 define a first stretching axis 184 and an orthogonal second stretching axis 186. Openings 178 may have any suitable sizes and/or shapes for altering stretching characteristics of a sheet of material. In some examples, openings 178 have varying sizes and/or shapes within a zone. For example, openings 178 may change in size and/or shape along one or more axes, such that elasticity is configured to change along the axis(es). For example, one or more dimensions of the openings may become smaller or larger along a longitudinal axis, forming a gradation with a corresponding stretch gradient. The openings may be larger in areas of the four-way stretch layer configured to have greater amounts of stretch and smaller in areas of the four-way stretch layer configured to have lesser amounts of stretch. In some examples, an amount of stretch is configured to gradually change along a first axis (e.g., first stretching axis 184) and to be substantially consistent along a second axis (e.g., second stretching axis 186). In some examples, such as when openings are substantially rectangular, the openings are roughly equal in length along one side, but vary in length along a second side (See FIG. 13). Rows and/or columns of the array of openings 178 are aligned with first and second stretching axes 184 and 186, enabling sheet 174 to stretch along directions parallel to the first and second stretching axes, or in any direction in the X-Y plane. In some examples, stretchable sheet 174 is configured to stretch or elastically deform in any given direction. Accordingly, a portion of sheet 100 including intermediate four-way stretch layer 170 is suitable for forming a four-way stretch zone, such as zones 340 and 350 of upper 300. Sheet 174 may have any suitable number of openings 178.

In some examples, intermediate four-way stretch layer 170 is configured to have less stretch (e.g., a lower elasticity) than first and second outer layers 105 and 110. In some examples, sheet 100 may include intermediate four-way stretch layers comprising foams of different thicknesses to modulate a stretching capability of the overall material. In some examples, sheet 100 includes a variety of adhesive patterns applied to intermediate four-way stretch layer to modulate a stretching capability of the material within specific regions of the sheet. In some examples, sheet 100 includes four-way stretch regions which do not include four-way stretch layer 170 and instead include only outer layers 105 and 110.

In general, axes 184 and 186 are aligned with the stretching axes of layers 105 and 110 so as to provide four-way stretch. Alternatively, sheet 174 may be oriented such that axes 184 and 186 form an angle relative to the axes of layers 105 and/or 110. This arrangement may provide a stretch zone having another desired predetermined type and/or degree of stretching ability.

Figure 14:
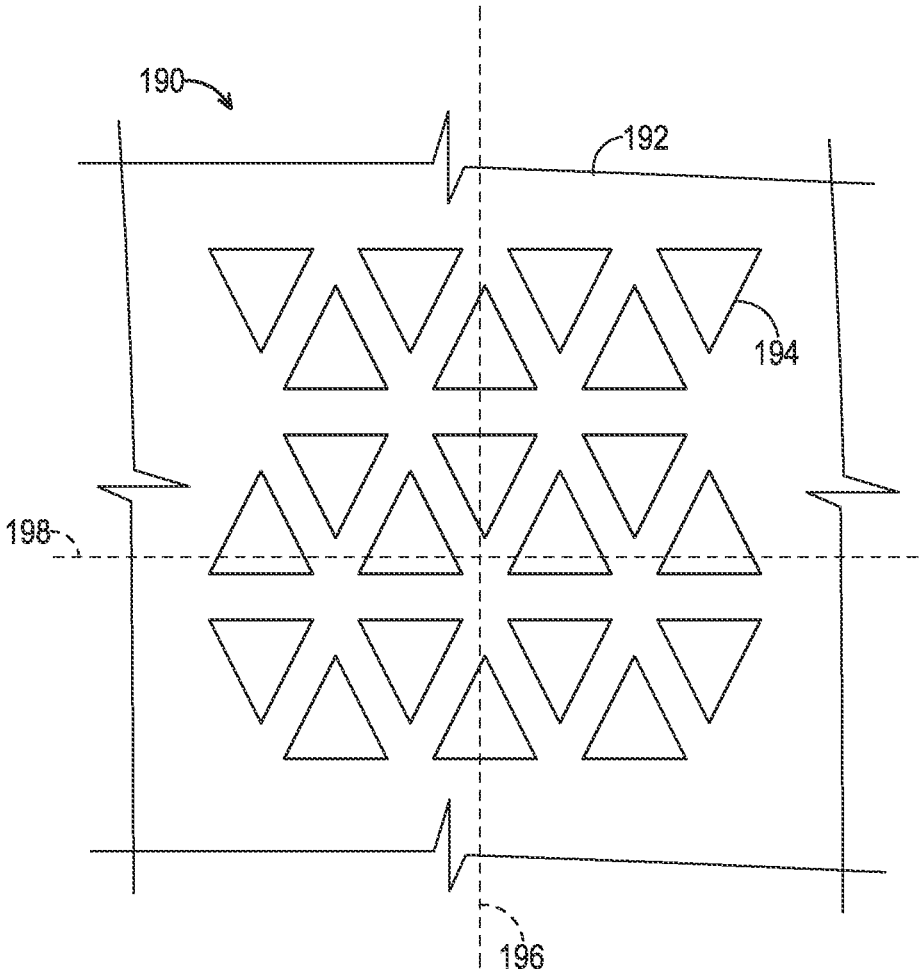
FIG. 14 is a top view of an illustrative intermediate layer suitable for inclusion in the layered material of FIG. 1 for forming a six-way stretch zone.

Intermediate layers suitable for use in sheet 100 may include a variety of stretch axes and openings or adhesive patterns combined to produce desired stretch characteristics. In some examples, an intermediate layer includes a stretchable sheet (e.g., of foam) having hexagonal openings and three axes, which may provide a six-way stretch material. In some examples, an intermediate layer 190 includes a stretchable sheet 192 including triangular openings 194, which may provide a three-way or six-way stretch material depending on an arrangement of the triangular openings. (See FIG. 14) In some examples, sheet 192 is configured to stretch along first and second stretch axes 196, 198. Sheets including hexagonal or triangular openings may be more suitable for shoes designed for wearers having bunions, or for other shoes requiring roughly spherical or otherwise rounded upper portions.

Sheet 100 may in general comprise any suitable number of stretch and/or non-stretch zones defined by regions of the sheet having same or different intermediate layers. In some examples, the intermediate layer of sheet 100 comprises multiple pieces of suitable materials and/or patterns, coupled together by outer layers 105 and 110 to form a continuous sheet. In some examples, the intermediate layer comprises multiple different materials, such as adhesives, foams, and/or the like disposed in different regions of sheet 100. In some examples, sheet 100 comprises two or more intermediate layers providing different stretching abilities, such as an adhesive layer and a foam layer. This enables a footwear upper having different stretch zones to be formed from a single continuous sheet (e.g., sheet 100). In some examples, however, a footwear upper can comprise several discrete examples of sheet 100 joined together in any suitable manner.

Figure 4:
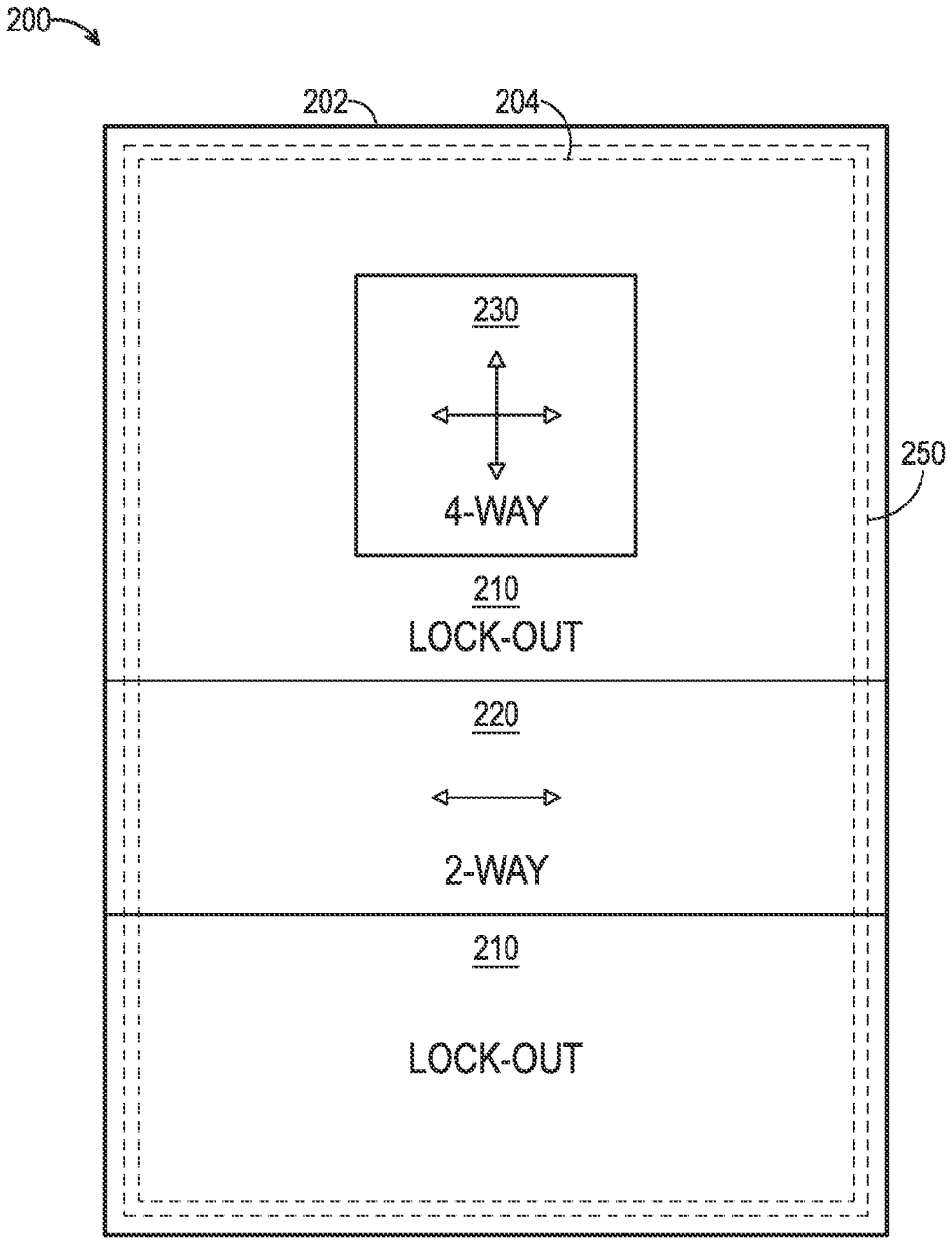
FIG. 4 is a schematic diagram of an illustrative layered material including a plurality of stretch zones.

FIG. 4 depicts a sheet of material 200 including a plurality of stretch zones. Sheet 200 includes one or more lock-out zones 210, one or more two-way stretch zones 220, and one or more four-way stretch zones 230 within a single continuous sheet. Sheet 200 may comprise sheet 100, or any other suitable material including a plurality of stretch zones within a single piece. In some examples, sheet 200 is utilized to manufacture a multi-stretch zone upper made of a single continuous sheet. Manufacturing an upper using sheet 200 may include cutting an upper shape out of sheet 200, sewing the upper to itself (thereby creating a seam, e.g., at the heel), and lasting the upper.

Sheet 200 includes two elastic outer layers 202, 204, which are substantially identical to outer layers 105 and 110 of material 100. Sandwiched between outer layers 202 and 204 is an intermediate layer 250, which includes one or more materials configured to provide specific stretch characteristics within the stretch zones of sheet 200. Intermediate layer 250 may include a single piece of material (e.g., foam, fabric) having a plurality of stretch characteristics, or may include multiple members or materials (e.g., foam, fabric, adhesive) coupled or bonded to the outer layers at selected regions of the sheet. In some examples, outer layers 202 and 204 and intermediate layer 250 are uncoupled from each other. Lasting an upper made from sheet 200 may activate a heat-activated adhesive and thereby adhere or bond intermediate layer 250 to outer layers 202 and 204.

In some examples, portions of the intermediate layer disposed within lock-out zones 210 comprise an intermediate lock-out layer substantially identical to lock-out layer 120, as described above. In some examples, portions of the intermediate layer disposed within lock-out zones 210 comprise layers of any suitable material configured to resist stretching during use, such as adhesive, inelastic tape, fabrics, foams, and/or the like.

In some examples, portions of the intermediate layer disposed within two-way stretch zones 220 are substantially identical to intermediate two-way stretch layer 140, described above. In some examples, portions of the intermediate layer disposed within two-way stretch zones 220 comprise layers of any suitable material configured to stretch only along a single axis during use, such as adhesive, tape, fabrics, foams, and/or the like.

In some examples, portions of the intermediate layer disposed within four-way stretch zones 230 are substantially identical to intermediate four-way stretch layer 170, described above. In some examples, portions of the intermediate layer disposed within four-way stretch zones 230 comprise layers of any suitable material configured to stretch along two or more axes during use, such as adhesive, tape, fabrics, foams, and/or the like. In some examples, the intermediate layer is omitted within four-way stretch zones 230 and elastic outer layers 202 and 204 are bonded to each other.

Sheet 200 may include any number of stretch zones arranged in any suitable arrangement for providing desired properties to a sheet of material. In some examples, sheet 200 includes only two stretch zones.

B. Illustrative Upper

With reference to FIGS. 5-8, this section describes an illustrative upper 300 in accordance with aspects of the present teachings. Upper 300 is an example of the uppers having a plurality of stretch zones integrated within a single sheet or piece of material, as described above. Upper 300 is depicted schematically in FIGS. 5-8, where a pattern on an illustrative shoe last indicates the arrangement of stretch zones within upper 300. Upper 300 may comprise sheet 100 and/or sheet 200, as described above.

Figure 5:
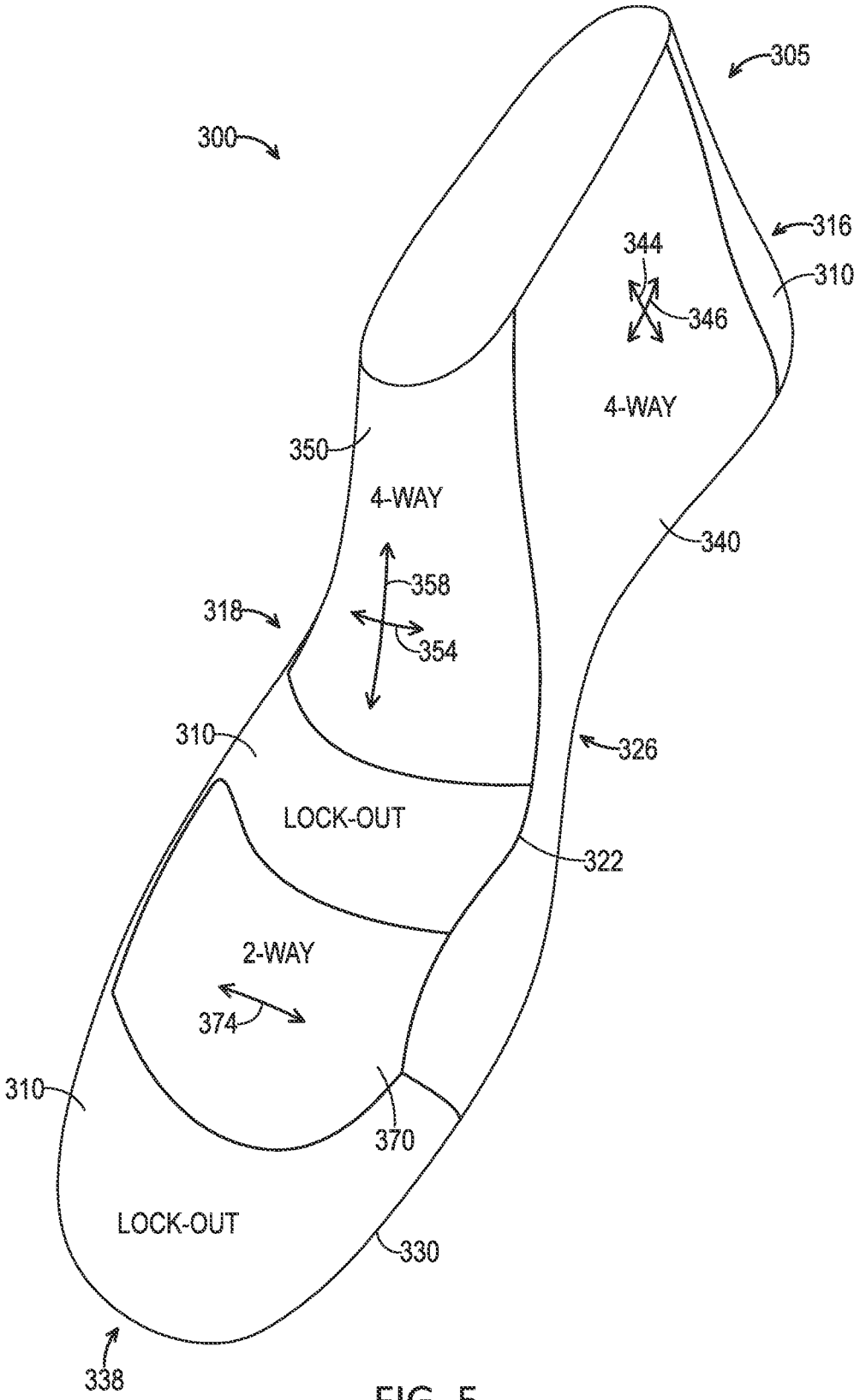
FIG. 5 is a schematic isometric view, depicted as marked on a last, of an illustrative footwear upper including stretch zones in accordance with aspects of the present disclosure.
Figure 6:
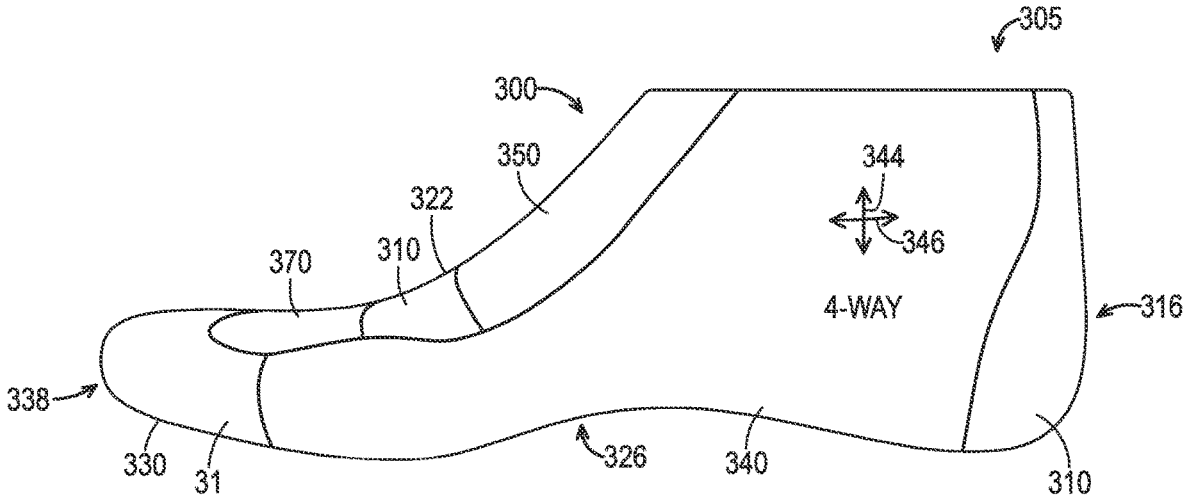
FIG. 6 is a medial side view of the upper of FIG. 5.
Figure 7:
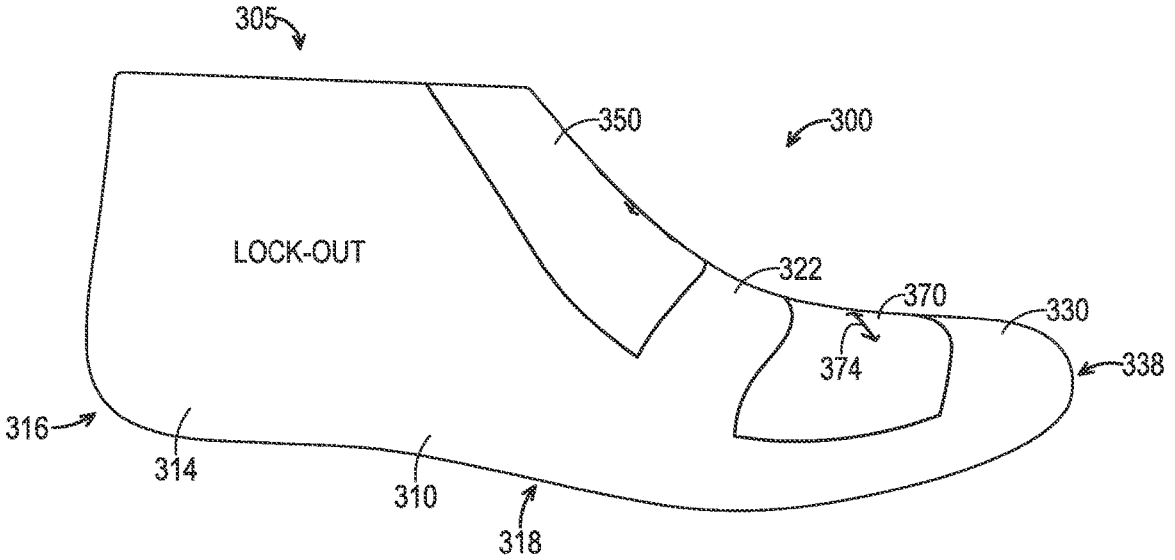
FIG. 7 is a lateral side view of the upper of FIG. 5.
Figure 8:
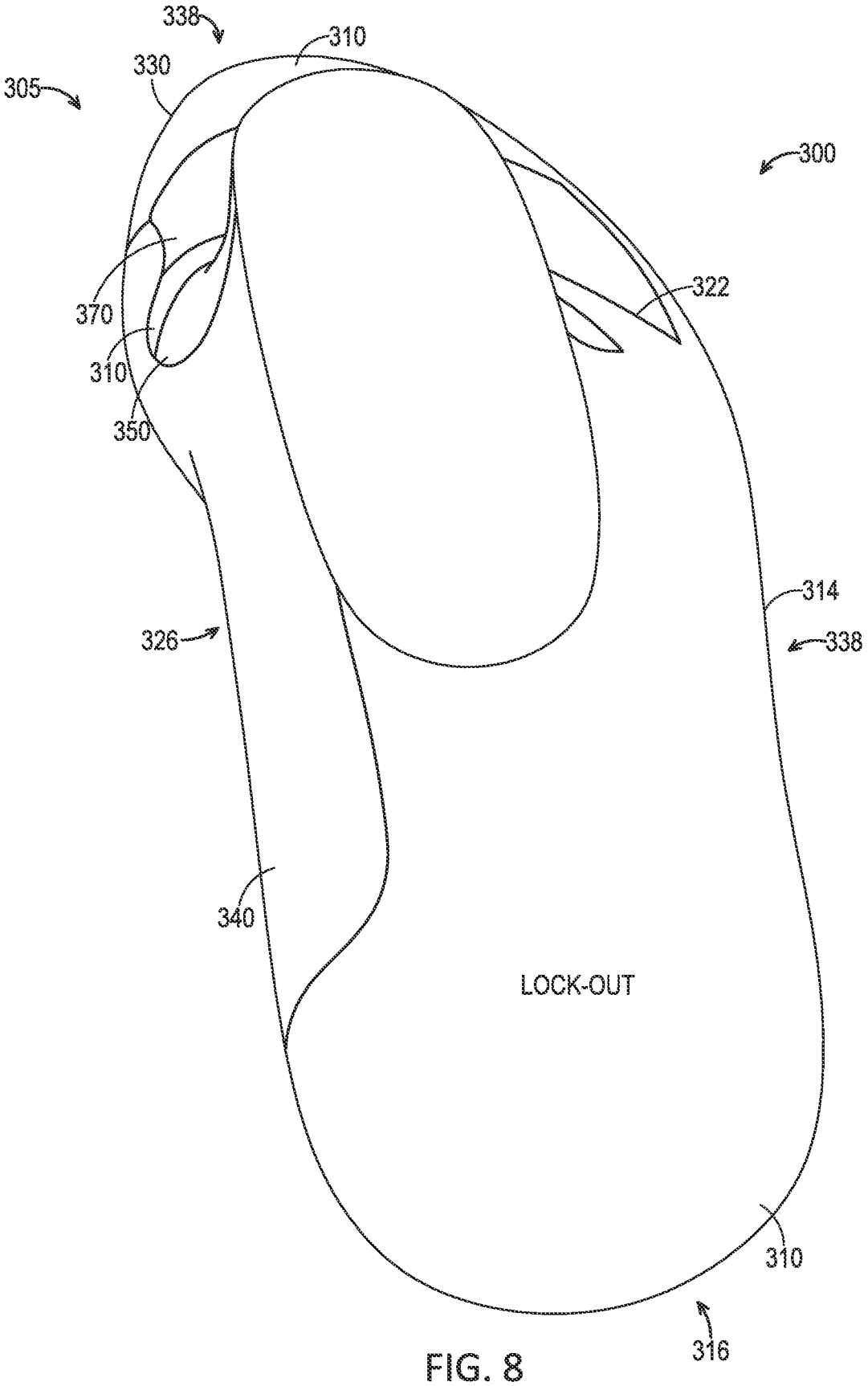
FIG. 8 is an isometric back view of the upper of FIG. 5.

Specifically, FIG. 5 is an isometric view of last 305, FIG. 6 is a medial side view of the last, FIG. 7 is a lateral side view of the last, and FIG. 8 is an isometric back view of the last. As shown on last 305, upper 300 includes a lock-out zone 310 (AKA an inelastic or non-stretch zone) configured to stretch little or not at all, when compared with other zones. Lock-out zone 310 has a main portion 314 extending along a heel portion 316 and a lateral portion 318 of upper 300 (see FIGS. 6-7). In some examples, main portion 314 only extends along sides of the last. In some examples, main portion 314 wraps partially around a top portion of the last, and may restrict supination of a wearer's foot. Main portion 314 helps to secure a wearer's foot against lateral movement relative to a sole of a shoe including upper 300, thereby reducing a likelihood of injury to the wearer.

Lock-out zone 310 further includes a top portion 322 extending from main portion 314 across a bridge and/or midfoot portion of upper 300 and terminating at or adjacent a medial portion 326 of the upper. In some examples, top portion 322 is disposed closer to an ankle of a wearer and restricts flexion of a ball portion of a wearer's foot. In some examples, top portion 322 is disposed closer to a toe of the wearer and restricts flexion of a wearer's toes. A toe portion 330 of lock-out zone 310 extends from main portion 314 along a toebox portion 338 of upper 300, terminating at medial portion 326 of the upper. In some examples, toe portion 330 terminates at a first knuckle of a wearer's toes. In some examples, toe portion 330 terminates at a second knuckle of a wearer's toes. In some examples, toe portion 330 terminates at a base of a wearer's toes. Top portion 322 and toe portion 330 each help to stabilize a wearer's foot. For example, top portion 322 helps to retain the foot against the sole of the shoe including upper 300, and toe portion 330 helps to stabilize the foot against unwanted movement toward the front edge of the toebox of the shoe.

Upper 300 further includes a medial four-way stretch zone 340 extending between a medial edge of toebox portion 338 and a medial edge of heel portion 316 of lock-out zone 310. Medial four-way stretch zone 340 is configured to stretch in a generally up-and-down direction, and in a generally toe-to-heel direction. These general directions are indicated in FIGS. 5-6 by a vertical axis 344 and a horizontal axis 346 orthogonal to the vertical axis. Due to the curvature of upper 300, the directions along which certain portions of medial four-way stretch zone 340 stretch are not necessarily coplanar with axes 344 and 146. For example, the vertical stretching direction is generally orthogonal to a plane defined by the sole of the wearer's foot only at some portions of medial four-way stretch zone 340. In some examples, medial four-way stretch zone 340 is configured to have more stretch along the vertical axis than along the horizontal axis.

A top four-way stretch zone 350 is disposed between top portion 322 of lock-out zone 310, main portion 314 of the lock-out zone, and medial four-way stretch zone 340. Top four-way stretch zone 350 is configured to stretch in a generally medial-lateral direction, and in a generally longitudinal direction orthogonal to the medial-lateral direction. In FIG. 5, first axis 354 generally indicates the medial-lateral direction, and second axis 358 generally indicates the longitudinal direction. Due to the curvature of upper 300, the stretching directions of top four-way stretch zone 350 are not necessarily coplanar with axes 354 and 358 at every portion of the top four-way stretch zone. In some examples, top four-way stretch zone 350 is configured to have more stretch along the second axis than along the first axis.

Upper 300 further includes a two-way stretch zone 370 disposed between top portion 322 and toe portion 330 of lock-out zone 310. Accordingly, two-way stretch zone 370 is disposed at a top portion of upper 300 behind the toebox portion. Two-way stretch zone 370 is configured to stretch in a medial-lateral direction, generally indicated in FIGS. 5 and 7 by axis 374. Due to the curvature of upper 300, the stretching direction of two-way stretch zone 370 is not necessarily coplanar with axis 374 at all portions of the two-way stretch zone. Two-way stretch zone 370 is configured to remain unstretched in all directions other than the medial-lateral direction. In some examples, two-way stretch zone is configured to extend along an axis of flexion of a foot.

In some examples, upper 300 comprises a single continuous sheet or piece of material including all of zones 310, 340, 350, and 370. Upper 300 may be constructed in any suitable manner. For example, upper 300 may comprise one or more pieces of material, at least one of which includes two or more different stretch zones. In some examples, upper 300 comprises multiple discrete pieces of material, each including one or more zones, that are attached together in any suitable way (e.g., by stitching, adhesives, and/or the like). For example, a first piece of material may comprise zones 310, 350 and 370 and a second piece of material may comprise zone 340.

C. Illustrative Layered Upper

Figure 9:
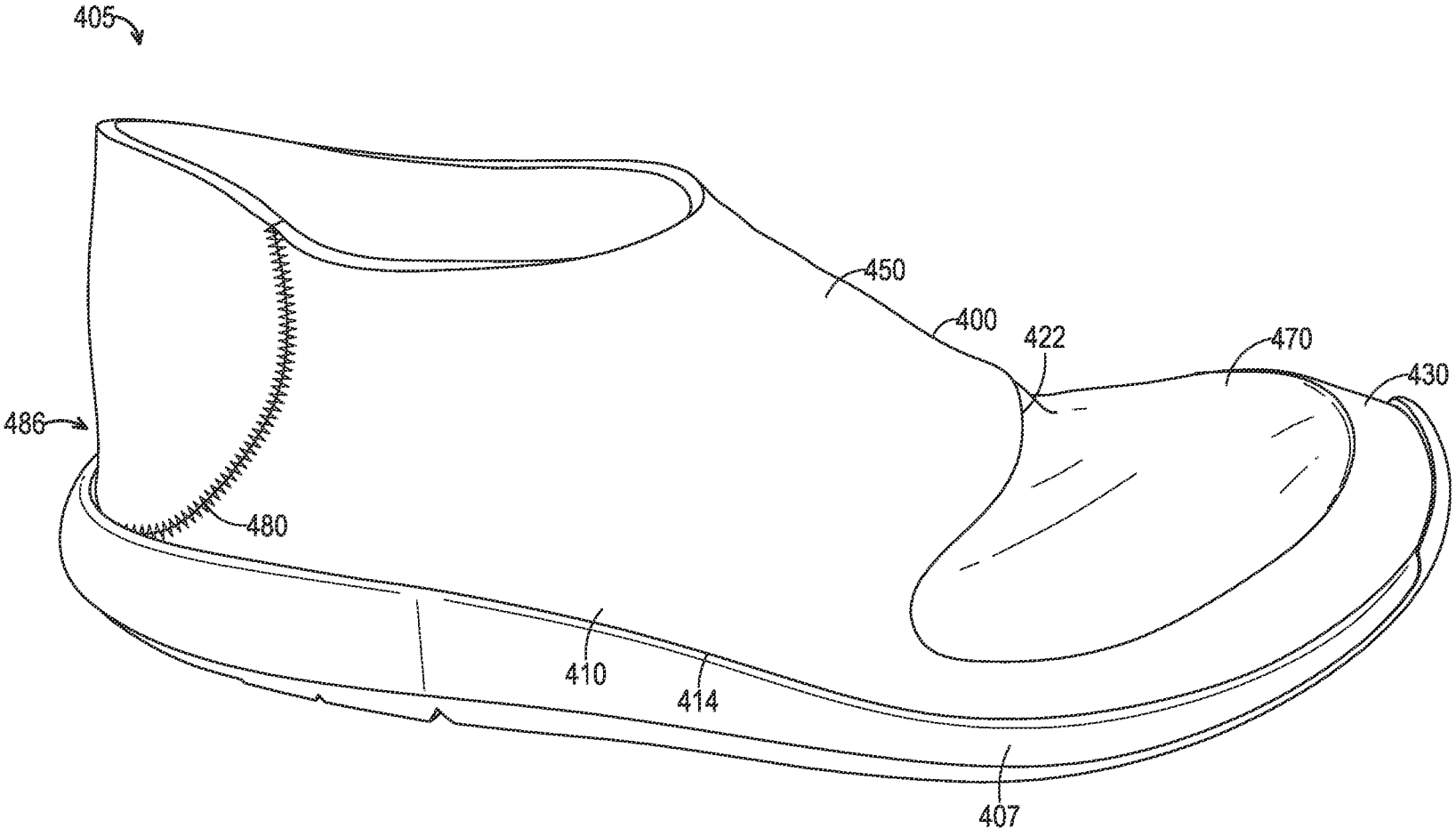
FIG. 9 is an isometric lateral view of an illustrative shoe having another illustrative upper in accordance with aspects of the present disclosure.
Figure 10:
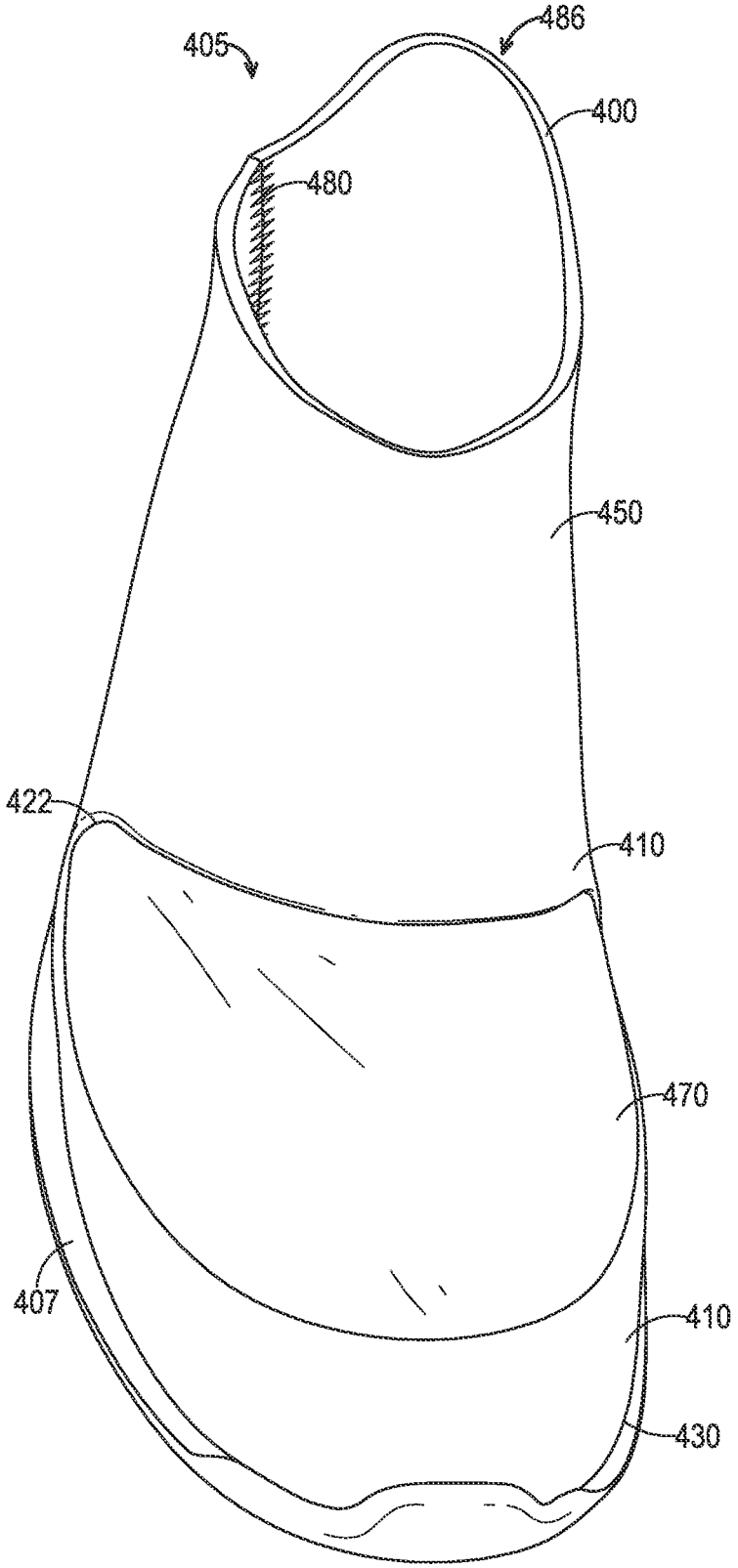
FIG. 10 is an isometric front view of the shoe of FIG. 9.
Figure 11:
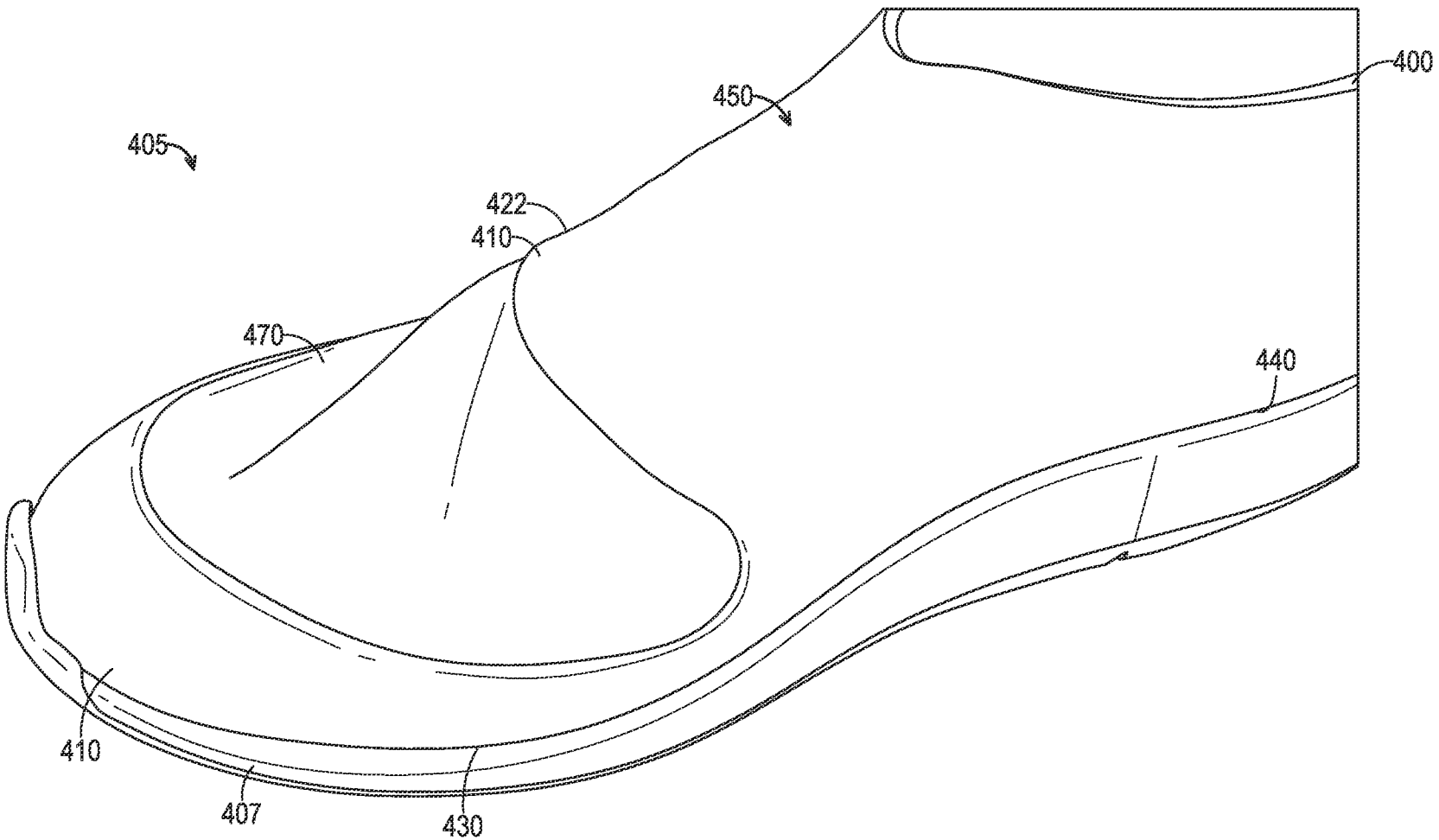
FIG. 11 is an isometric medial view of the shoe of FIG. 9.

With reference to FIGS. 9-11, this section describes an illustrative upper 400 comprising a single piece of layered material configured to have two or more stretch zones. Upper 400 is an example of an upper having the arrangement of stretch zones and non-stretch zones described above with reference to upper 300. More specifically, upper 400 comprises a single piece of layered material configured to have the arrangement of zones of upper 300. The zones of upper 400 are similar and/or identical to the zones of upper 300, described above.

FIGS. 9-11 depict a shoe 405 including upper 400 attached to a sole 407. In general, upper 400 may be attached to any suitable sole by any suitable mechanism to form any suitable shoe. FIG. 9 is a lateral isometric view of shoe 405, FIG. 10 is a front isometric view of the shoe, and FIG. 11 is a partial medial isometric view of the shoe. As FIGS. 9-11 show, upper 400 includes a lock-out zone 410 (AKA a non-stretch zone) having a main portion 414, a top portion 422, and a toe portion 430. Upper 400 further includes a medial four-way stretch zone 440, a top four-way stretch zone 450, and a two-way stretch zone 470 disposed between top portion 422 and toe portion 430 of lock-out zone 410. Zones 410, 440, 450, and 470 respectively are similar or identical to zones 310, 340, 350, and 370 of upper 300.

Upper 400 comprises a single piece of material configured to have respective stretching abilities corresponding to zones 410, 440, 450, and 470. Edges of the piece of material are joined at a seam 480 disposed near a heel portion 486 of upper 400. In general, any suitable material may be used to construct upper 400 and/or any other single-piece upper having a plurality of stretch zones. In some examples, upper 400 may be sewn or otherwise coupled to a Strobel board at bottom edges to produce a sock portion of a shoe.

Upper 400 may comprise any suitable material which is configured to include a plurality of zones having different stretching abilities. In some examples, upper 400 comprises materials including two external or outer layers and one or more intermediate layers configured to alter stretch characteristics of the material. In some examples, the outer layers comprise materials having four-way stretch capabilities, such as natural fabrics, synthetic fabrics, sheets of resilient materials (e.g., rubber, synthetic polymers) and/or the like. The intermediate layer comprises materials having specific stretch characteristics arranged such that different zones of the layered material have different stretch characteristics. Intermediate layers may comprise any suitable combination of materials for altering stretch characteristics of a material, such as foams, adhesives, fabrics, synthetic materials, and/or the like. In some examples, one or more intermediate layers includes foams having various thicknesses, which provide different levels of stretching ability. In some examples, one or more intermediate layers includes foams having perforations, holes, cuts, recesses, and/or openings, which change stretching ability of the unaltered foam materials. In some examples, one or more intermediate layers includes patterns of adhesive material (e.g., grids, lines, dots, etc.) which change stretching ability of the outer layers when adhered to the outer layers. The material may include any suitable combination of intermediate layers described above.

D. Illustrative Method

Figure 12:
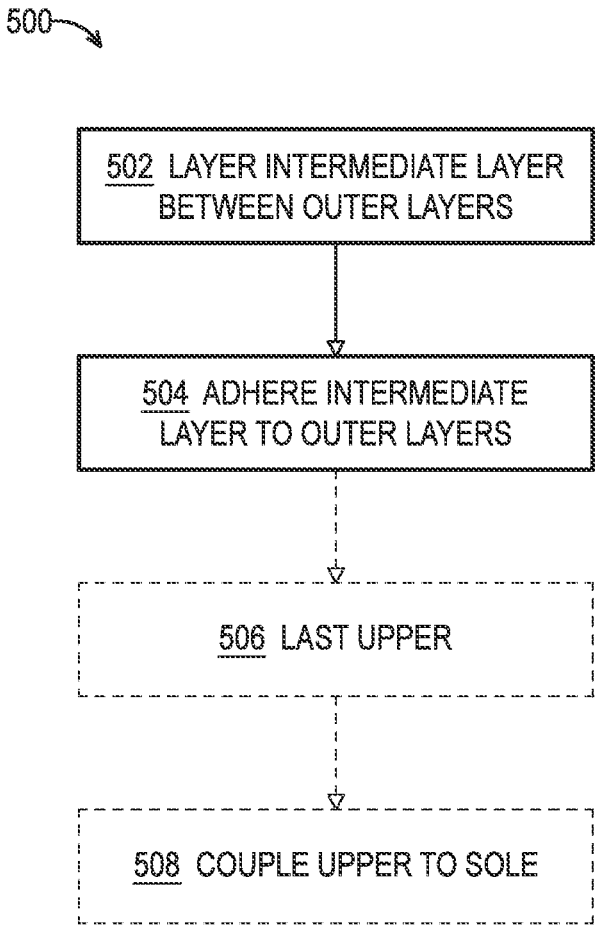
FIG. 12 is a flowchart depicting steps of an illustrative method for manufacturing a footwear upper comprising a plurality of stretch zones according to aspects of the present disclosure.

This section describes steps of an illustrative method 500 for manufacturing an upper having a plurality of stretch zones; see FIG. 12. Aspects of uppers and articles of footwear already described may be utilized in the method steps described below. Where appropriate, reference may be made to components and systems that may be used in carrying out each step. These references are for illustration, and are not intended to limit the possible ways of carrying out any particular step of the method.

FIG. 12 is a flowchart illustrating steps performed in an illustrative method, and may not recite the complete process or all steps of the method. Although various steps of method 500 are described below and depicted in FIG. 12, the steps need not necessarily all be performed, and in some cases may be performed simultaneously or in a different order than the order shown.

Step 502 of method 500 includes layering an intermediate layer of material between two outer layers of material. In some examples, the outer layers comprise a material having four-way stretch capabilities (e.g., fabrics, foams, natural or synthetic rubbers, etc.). In some examples, the outer layers comprise a material (fabrics, foams, natural or synthetic rubbers, etc.) having two-way stretch capabilities. The intermediate layer may comprise one or more materials configured to define stretch zones, such as foams, adhesive layers, fabrics, and/or the like. In some examples, the intermediate layer comprises foam having perforations configured to alter stretch capabilities of the foam material. In some examples, the intermediate layer comprises adhesive applied to inner surfaces of one or both outer layers in an engineered pattern. The adhesive may have different thicknesses or patterns depending on a desired stretch zone in a specific area. In some examples, portions of the intermediate layer comprise foam material and portions of the intermediate layer comprise an adhesive pattern. In some examples, the intermediate layer comprises both a foam layer and an adhesive pattern applied to the foam layer. In some examples, the intermediate layer comprises a continuous foam sheet. In some examples, the intermediate layer comprises discrete pieces of foam.

Step 504 of method 500 includes adhering the intermediate layer to the two outer layers. In some examples, adhering the intermediate layer includes applying an adhesive to the layers. In some examples, adhering the intermediate layer includes heat treating (e.g., with an oven) the layers, thereby activating an adhesive applied to the layers. In some examples, adhering the intermediate layer includes sewing the intermediate layer to the outer layers at external edges of the upper material.

The sheet generated by steps 502 and 504 may be utilized to form an upper for an article of footwear. Optional step 506 of method 500 includes lasting the upper. Lasting the upper may include fitting the upper around a last configured to fit the upper and applying heat to the last and to the upper, thereby shaping the upper to a human foot. In some examples, lasting the upper includes sewing heel edges of the upper to each other. In some examples, lasting the upper includes sewing or otherwise attaching a Strobel board to bottom edges of the upper, thereby forming a "sock" of a shoe including the upper.

In some examples, step 504 and optional step 506 may be performed simultaneously. Step 506 includes applying heat to the last and the upper may activate adhesive applied to the intermediate and outer layers, thereby bonding the layers. In some examples, the intermediate layer comprises adhesive and applying heat to the last and upper bonds the outer layers to each other.

Optional step 508 of method 500 includes coupling the lasted upper to a sole. The lasted upper may be coupled to a sole using any suitable method for bonding or otherwise connecting a flexible component to a more rigid component, such as sewing, bonding, adhesion, and/or the like.

E. Illustrative Combinations and Additional Examples

This section describes additional aspects and features of uppers having a plurality of stretch zones, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. An article of footwear, comprising:

a continuous sheet of layered material including a plurality of stretch zones, each stretch zone defined by a selected directional elasticity; and exactly one seam at which the continuous sheet is coupled to itself to form an upper;

wherein the plurality of stretch zones comprise at least two zones having different respective directional elasticities.

A1. The upper of A0, wherein the plurality of stretch zones comprise a first zone configured to be inelastic, and a second zone configured to stretch along only a single axis.

A2. The upper of A0 or A1, wherein the plurality of stretch zones comprise one or more stretch zones each configured to stretch along two axes.

A3. The upper of any one of paragraphs A0 through A2, wherein the continuous sheet comprises two outer layers comprising an elastic material and an intermediate layer disposed between and in direct contact with the two outer layers.

A4. The upper of A3, wherein the intermediate layer includes a plurality of patterns, each having different directional stretching characteristics.

A5. The upper of A3, wherein the intermediate layer comprises a perforated foam.

A6. The upper of any one of paragraphs A0 through A5, wherein the seam is disposed at a heel of the upper.

A7. The upper of any one of paragraphs A0 through A6, wherein at least one of the stretch zones is configured such that the directional elasticity of the stretch zone changes along a dimension of the stretch zone.

A8. The upper of A7, wherein the at least one of the stretch zones includes two outer layers comprising an elastic material and an intermediate layer disposed between and in direct contact with the two outer layers, the intermediate (e.g., foam) layer having perforations therein of different sizes and/or shapes.

B0. An article of footwear, comprising:

an upper including a single continuous sheet comprising two or more stretch zones, each stretch zone having a different directional stretching capability; and a sole coupled to the upper.

B1. The article of footwear of B0, wherein the two or more stretch zones include one or more inelastic zones, one or more stretch zones configured to stretch along a single axis, and one or more stretch zones configured to stretch along two axes.

B2. The article of footwear of B0 or B1, wherein the single continuous sheet comprises two continuous outer layers and a non-continuous intermediate layer disposed between and in direct contact with the two outer layers.

B3. The article of footwear of B2, wherein the outer layers are configured to stretch along two different axes.

B4. The article of footwear of B2 or B3, wherein the intermediate layer includes a plurality of patterns defining different directional stretching capabilities.

B5. The article of footwear of any one of paragraphs B2 through B4, wherein the intermediate layer comprises a foam lattice.

B6. The article of footwear of any one of paragraphs B0 through B5, wherein the single continuous sheet is attached to itself at a single seam.

B7. The upper of any one of paragraphs B0 through B6, wherein at least one of the stretch zones is configured such that the directional elasticity of the stretch zone changes along a dimension of the stretch zone.

B8. The upper of B7, wherein the at least one of the stretch zones includes two outer layers comprising an elastic material and an intermediate layer disposed between and in direct contact with the two outer layers, the intermediate (e.g., foam) layer having perforations therein of different sizes and/or shapes.

C0. A method of manufacturing an upper for an article of footwear, the method comprising:

sandwiching a patterned intermediate layer between two elastic outer layers;

connecting the intermediate layer to the outer layers to form a single continuous sheet including a plurality of zones having different stretch characteristics due to the patterned intermediate layer;

forming an upper out of the single continuous sheet; and lasting the upper.

C1. The method of C0, further comprising coupling the lasted upper to a sole.

C2. The method of C0 or C1, further comprising forming the intermediate layer by perforating a foam sheet to alter stretch capabilities of the foam.

C2A. The method of C2, wherein perforating includes creating perforations of different sizes and/or shapes within a single zone (e.g., a gradation of sizes and/or shapes).

C3. The method of any one of paragraphs C0 through C2, wherein sandwiching the intermediate layer between two outer layers comprises applying adhesive to inner surfaces of at least one of the outer layers in a selected pattern.

C4. The method of any one of paragraphs C0 through C3, wherein connecting the intermediate layer to the outer layers includes applying heat to the upper.

C5. The method of C4, wherein lasting the upper includes applying the heat to the upper while fitted around a last.

Advantages, Features, and Benefits

The different embodiments and examples of the footwear uppers described herein provide several advantages over known solutions for providing a footwear upper configured to suitably stabilize a wearer's foot. For example, illustrative embodiments and examples described herein allow a footwear upper to comprise a single continuous sheet or piece of layered material. In contrast to other uppers, uppers comprising a single piece can require one or even zero seams or other connection points. Accordingly, the process of manufacturing a single-piece upper can be relatively simple. Furthermore, due to its reduced number of connection points, a single-piece upper has relatively fewer failure points, resulting in a more durable shoe. Additionally, the continuous sheet presents a unique and visually appealing appearance.

Additionally, and among other benefits, illustrative embodiments and examples described herein allow an upper having an arrangement of stretch zones configured to better stabilize a wearer's foot.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. An upper for an article of footwear, comprising:

a continuous sheet of layered material including a plurality of stretch zones, each stretch zone defined by a selected directional elasticity, wherein the continuous sheet includes two continuous outer layers, and at least two of the plurality of stretch zones have different respective directional elasticities;

a first stretch zone of the plurality of stretch zones having an intermediate foam layer disposed between and in direct contact with each of the two continuous outer layers;

wherein the intermediate foam layer of the first stretch zone has a lattice structure including at least one pattern of openings configured to stretch along one or more predetermined stretch axes, such that the at least one pattern of openings in the intermediate foam layer determines the directional elasticity of the first stretch zone; and exactly one seam at which the continuous sheet is coupled to itself to form an upper.

2. The upper of claim 1, wherein the first stretch zone is configured to stretch along only a single axis, and the plurality of stretch zones further comprise a second zone configured to be inelastic.

3. The upper of claim 1, wherein the first stretch zone is configured to stretch along two axes.

4. The upper of claim 1, wherein the continuous outer layers each comprise an elastic material.

5. The upper of claim 1, wherein the intermediate foam layer of the first stretch zone extends to a second stretch zone and includes a second pattern of openings determining a directional elasticity of the second stretch zone, wherein the directional elasticity of the second stretch zone is different that the directional elasticity of the first stretch zone.

6. The upper of claim 1, wherein at least one of the plurality of stretch zones is configured such that the directional elasticity of the stretch zone changes along a dimension of the stretch zone.

7. The upper of claim 1, wherein the pattern of openings includes openings of different sizes.

8. An article of footwear, comprising:

an upper including a single continuous sheet comprising two or more stretch zones, each stretch zone having a different directional stretching capability;

wherein the continuous sheet of the upper includes two continuous outer layers;

wherein a first stretch zone of the two or more stretch zones includes an intermediate layer of foam disposed between and in direct contact with each of the two continuous outer layers;

wherein the intermediate layer of foam of the first stretch zone has a non-continuous structure including at least one pattern of openings configured to stretch along one or more predetermined stretch axes, such that the at least one pattern of openings determines the directional stretching capability of the first stretch zone; and a sole coupled to the upper.

9. The article of footwear of claim 8, wherein the two or more stretch zones include one or more inelastic zones and one or more stretch zones configured to stretch along a single axis, and the first stretch zone is configured to stretch along two axes.

10. The article of footwear of claim 8, wherein each of the two continuous outer layers is configured to stretch along two axes.

11. The article of footwear of claim 8, wherein the intermediate layer of foam extends to a second stretch zone and includes at least a second pattern of openings determining a directional stretching capability of the second stretch zone, the directional stretching capability of the second stretch zone being different from the directional stretching capability of the first stretch zone.

12. The article of footwear of claim 8, wherein the intermediate layer comprises a foam lattice.

13. The article of footwear of claim 8, wherein the single continuous sheet is attached to itself at a single seam.

14. The upper of claim 8, wherein the intermediate layer further includes a pattern of adhesive.

* * * * *